United States Patent [19]

Rostron

[11] 4,075,447

[45] Feb. 21, 1978

[54] DOUBLE-PUFFER-TYPE COMPRESSED-GAS CIRCUIT-INTERRUPTER CONSTRUCTIONS

[75] Inventor: Joseph R. Rostron, Monroeville, Pa.

[73] Assignee: Westinghouse Electric Corporation, Pittsburgh, Pa.

[21] Appl. No.: 560,461

[22] Filed: Mar. 21, 1975

[51] Int. Cl.[2] ..... H01H 33/70

[52] U.S. Cl. ..... 200/148 A; 200/150 G; 200/144 AP

[58] Field of Search ..... 200/148 A, 150 G, 144 AP

[56] References Cited

U.S. PATENT DOCUMENTS

| | | | |
|---|---|---|---|
| 2,095,441 | 10/1937 | Howe | 200/150 G |
| 3,214,550 | 10/1965 | Easley | 200/148 A |
| 3,291,948 | 12/1966 | Telford | 200/148 A |
| 3,621,171 | 11/1971 | Yoshioka | 200/148 A |
| 3,899,650 | 8/1975 | Kishi et al. | 200/148 A |
| 3,946,184 | 3/1976 | Yoshioka et al. | 200/148 A |

*Primary Examiner*—Robert S. Macon

*Attorney, Agent, or Firm*—W. R. Crout

[57] ABSTRACT

A high-voltage gas-type circuit-interrupter is provided utilizing a pair of serially-related puffer-type circuit-interrupters mechanically connected together, and operated by a single common operating rod. The stationary contact structures may be supported by rods attached to the interrupter support plate, or, alternatively, by a pair of terminal-bushings extending downwardly interiorly within a surrounding metallic tank at ground potential, for example.

The operating arrangement may be such as to involve a linearly movable generally vertically extending common operating rod actuated externally of the grounded gas-filled tank by a suitable operating mechanism.

Preferably, the individual puffer-type gas interrupters each involves the linear-slidable operation of a movable operating gas-compression cylinder, carrying the movable contact structure and an insulating nozzle orifice movable over a relatively stationary fixed piston structure.

11 Claims, 8 Drawing Figures

OPEN POSITION

OPEN POSITION

DOUBLE-PUFFER-TYPE COMPRESSED-GAS CIRCUIT-INTERRUPTER CONSTRUCTIONS

CROSS-REFERENCES TO RELATED APPLICATIONS

Reference may be made to my related piston patent application filed by me on May 12, 1975, Ser. No. 576,820, now U.S. Pat. No. 3,987,262, issued Oct. 19, 1976, and to U.S patent application filed Aug. 7, 1975, Ser. No. 602,705 now U.S. Pat. No. 4,044,211 issed Aug. 23, 1977 to Charles F. Cromer et al. entitled "Improved Puffer-Type Compressed-Gas Circuit-Interrupter." Also, reference may be had to U.S. patent application filed Sept. 25, 1975, Ser. No. 616,703 by Joseph R. Rostron et al., entitled "Improved Puffer-Type Compressed-Gas Circuit-Interrupter," all of the aforesaid patent applications being assigned to the assignee of the instant patent application.

BRIEF SUMMARY OF THE INVENTION

In accordance with the principles of the present invention, a gas-filled grounded metallic tank, for example, is provided, into which extends a pair of spaced terminal-bushings. A stationary contact is supported at the lower end of each of the two downwardly extending terminal-bushings, or, alternatively, from rods extending up from the interrupter support plate. Disposed within the tank structure is a pair of conjointly operated serially related puffer-type gas circuit-interrupters, in which the movable operating gas-compression cylinders are attached to a common operating rod, which simultaneously effects the actuation of both cooperating operating cyclinders, together with their movable contact structures, over relatively fixed piston members. Preferably, the pair of fixed piston members are stationarily supported by an upwardly extending supporting structure, and the common operating rod extends generally vertically downwardly, and may be operated externally of the surrounding tank structure by a suitable externally disposed operating mechanism for example.

The operation of each individual puffer-type gas circuit-interrupter unit effects a compression of a suitable arc-extinguishing gas, such as sulfur-hexafluoride ($SF_6$) gas, for example, out through the movable hollow orifice structure of the respective interrupting unit, and into intimate engagement with the arc established within said interrupting unit, thereby effecting its rapid extinction. The higher voltages are accommodated by the utilization of two such puffer-type structures, disposed in electrical series, so that each need interrupt only half of the total line voltage.

DESCRIPTION OF THE PREFERRED EMBODIMENTS

Figure 1:
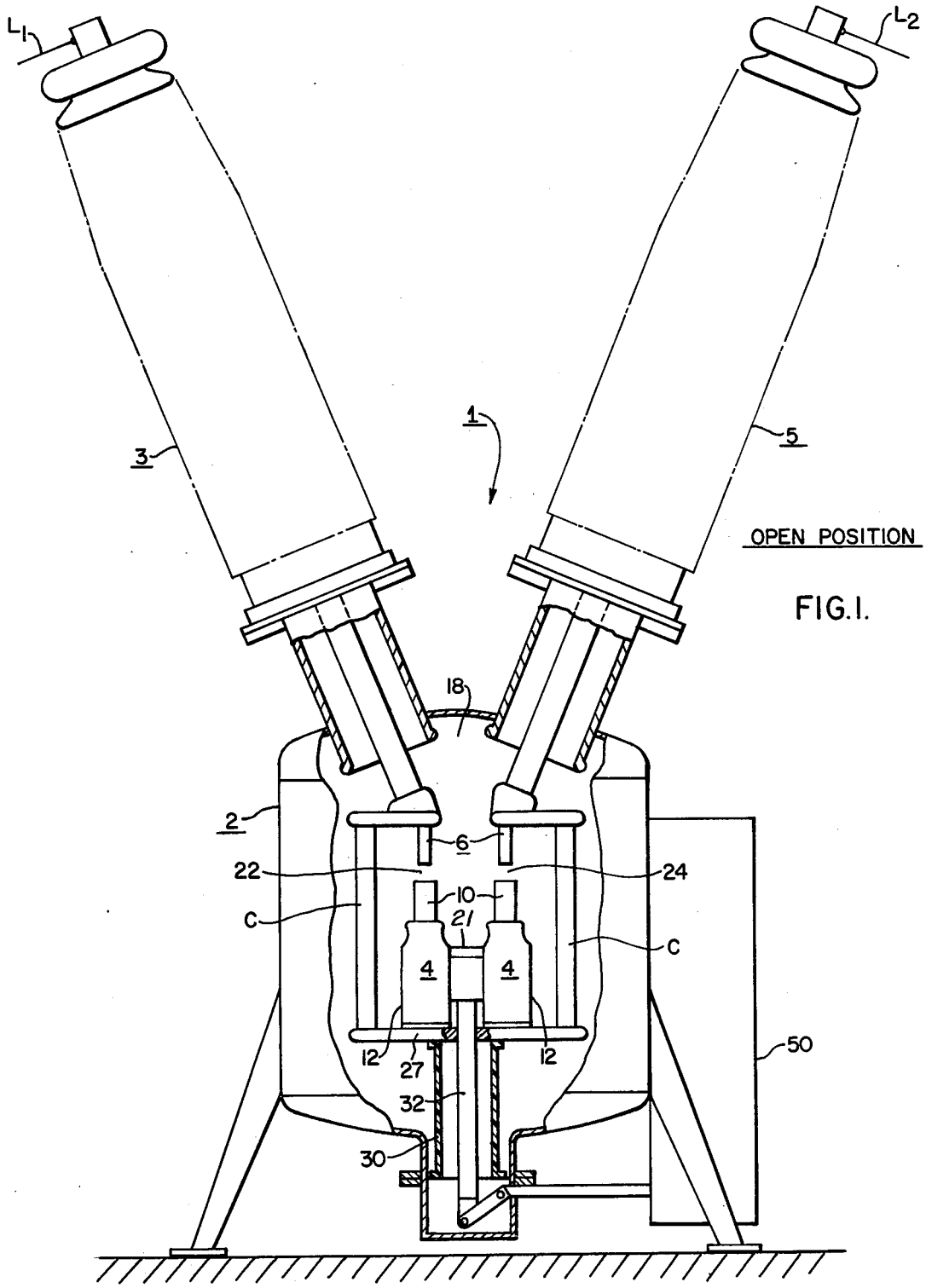
FIG. 1 is a partial vertical sectional view taken through a high-voltage circuit-interrupter embodying the principles of the present invention, the contact structure being illustrated in the open-circuit position.
Figure 8:
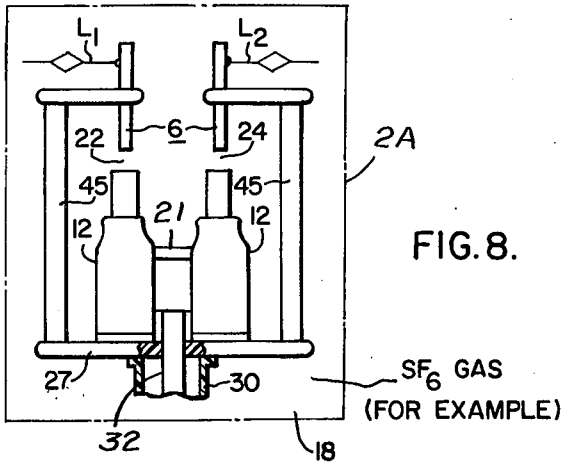

With reference to FIG. 1 of the drawings, it will be observed that there is provided a circuit-interrupter 1 disposed within a metallic tank structure 2, preferably at ground potential, having a pair of serially related puffer-type gas-flow interrupting units 4. As set forth in U.S. Pat. Nos. 3,670,124 — Calvino, 3,670,125 — Calvino, 3,712,969 — Calvino et al. and 3,602,670 — Calvino, each of the puffer-type gas-flow interrupting units 4 comprises a relatively stationary contact structure 6 and a cooperable movable contact structure 8 having affixed thereto an insulating nozzle-shaped orifice structure 10, which moves downwardly with an operating cylinder 12. The stationary contacts 6 may be attached to the interior ends of a pair of spaced terminal-bushings 3 and 5, or, alternatively, supported from the interrupter support plate 27 by insulating supports 45 (FIG. 8).

Figure 3:
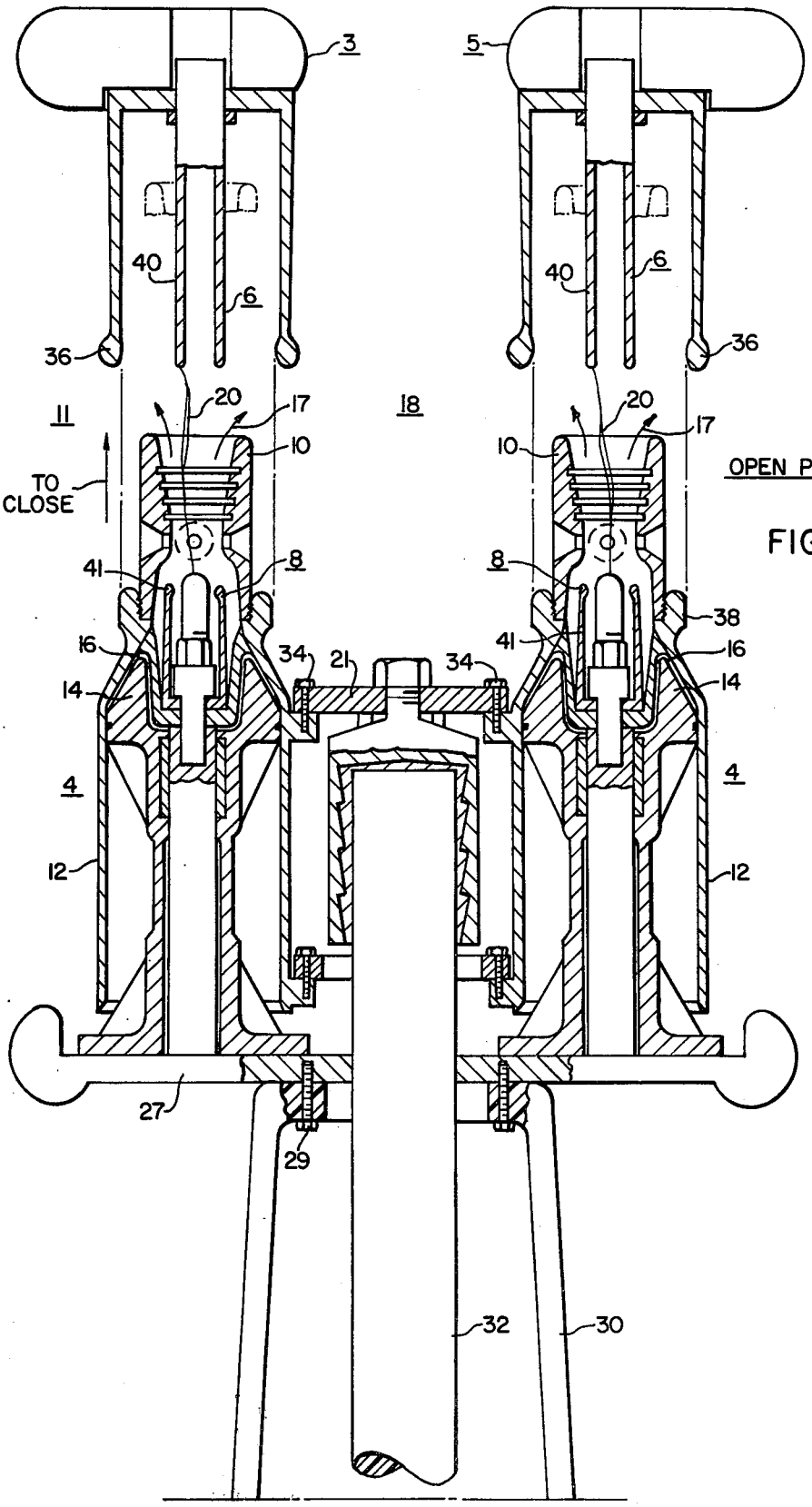
FIG. 3 illustrates to an enlarged scale a vertical sectional detailed view taken through the two serially related puffer-type interrupting units, the contact structures being illustrated in the fully open circuit position.
Figure 4:
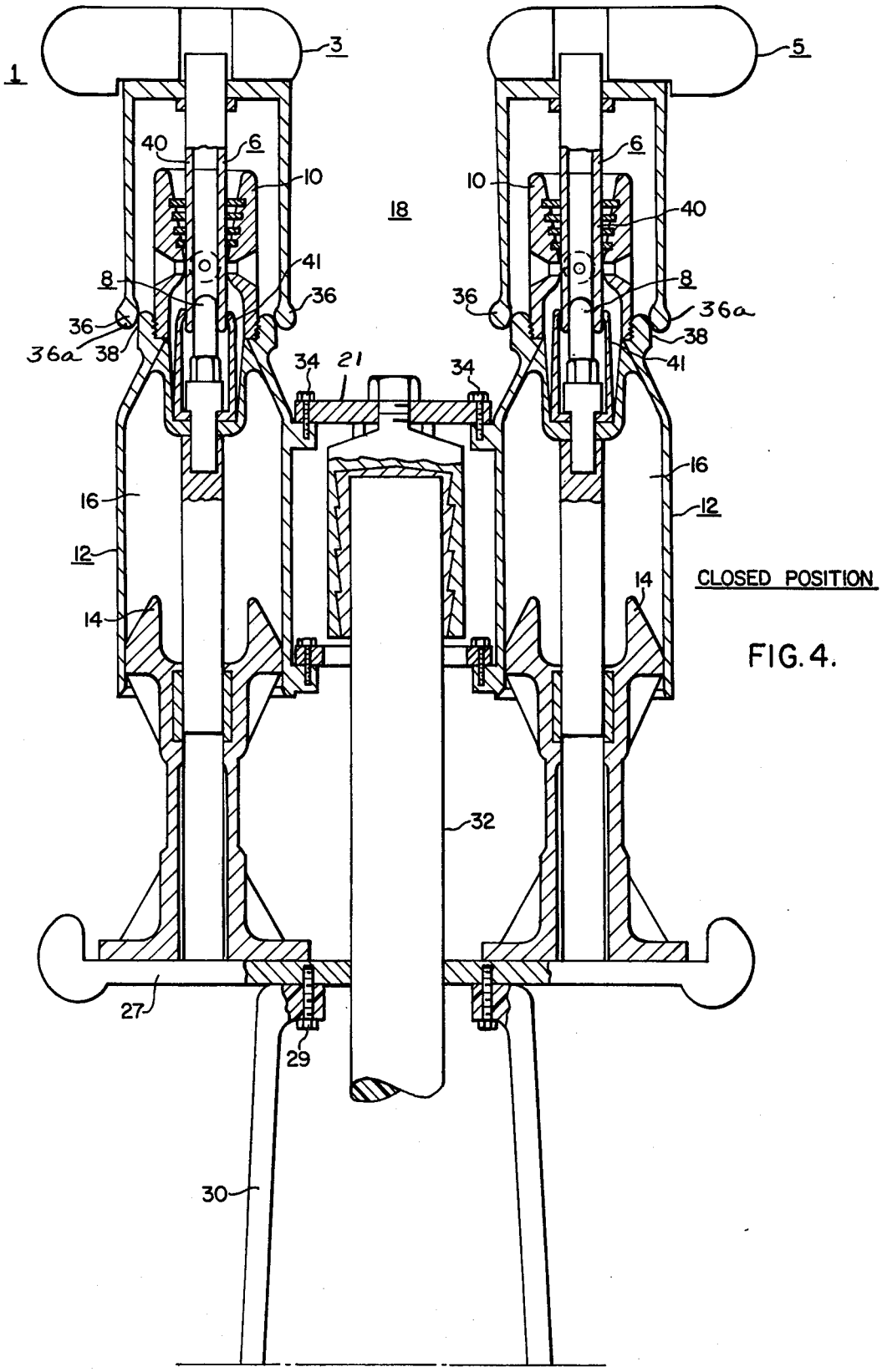
FIG. 4 is a view similar to that of FIG. 3, but illustrating the circuit-breaker in the closed-circuit position.

The operating cylinder 12, as shown in FIG. 3, slidably moves over a relatively fixed piston structure 14, thereby compressing a suitable arc-extinguishing gas 18 within the gas-compression region, 16 (FIG. 4).

The compression of the gas 18, such as sulfur-hexafluoride ($SF_6$) gas, for example, within the compression chamber 16, (FIG. 4) effects the upward flow thereof into the established arc 20 (FIG. 3) drawn between the stationary and movable contact structures 6 and 8, as indicated by the arrows 17. Arc extinction soon follows and a pair of serially related breaks 22, 24 are established, as indicated in FIG. 1 of the drawings. Capacitance rods "C" shunting the breaks 22 and 24, may serve to divide the applied voltage between the two interrupting units 4 and assist in supporting the stationary contacts 6, as shown in FIG. 1.

It will be observed that both stationary fixed piston structures 14 are supported in spaced lateral relationship by a horizontally extending ring-shaped support-plate member 27, the latter being affixed, as by mounting bolts 29, to an upstanding insulating support-pedestal 30 (FIG. 3).

An operating rod 32 is bolted, as by mounting bolts 34, to the spaced-apart movable operating cylinders 12, which carry the movable contact structures 8 and also the movable insulating nozzle structures 10. The individual insulating nozzles 10 may conform to the teachings set forth in U.S. Pat No. 3,291,948, issued Dec. 13, 1966 to James M. Telford, and assigned to the assignee of the instant application.

In the closed-circuit position of the device 1, as shown in FIG. 4 the main stationary contact fingers 36 electrically engage the external sides 38 of the metallic operating cylinders 12 to thereby carry the series line current $L_1$, $L_2$ through the interrupters 4 in the closed-circuit position of the device 1, as illustrated in FIG. 4 of the drawings. During the opening operation, the main contact fingers 36 separate prior to a subsequent separation of the cooperable arcing contacts 40, 41. There then results the establishment of two serially related arcs 20 (FIG. 3) between the stationary arcing contacts 40 and the movable arcing contacts 41, with the two series arcs 20 being drawn through the two insulating orifices 10. Gas flow ensues, by compressive action as heretofore described, and arc extinction quickly follows.

Figure 2:
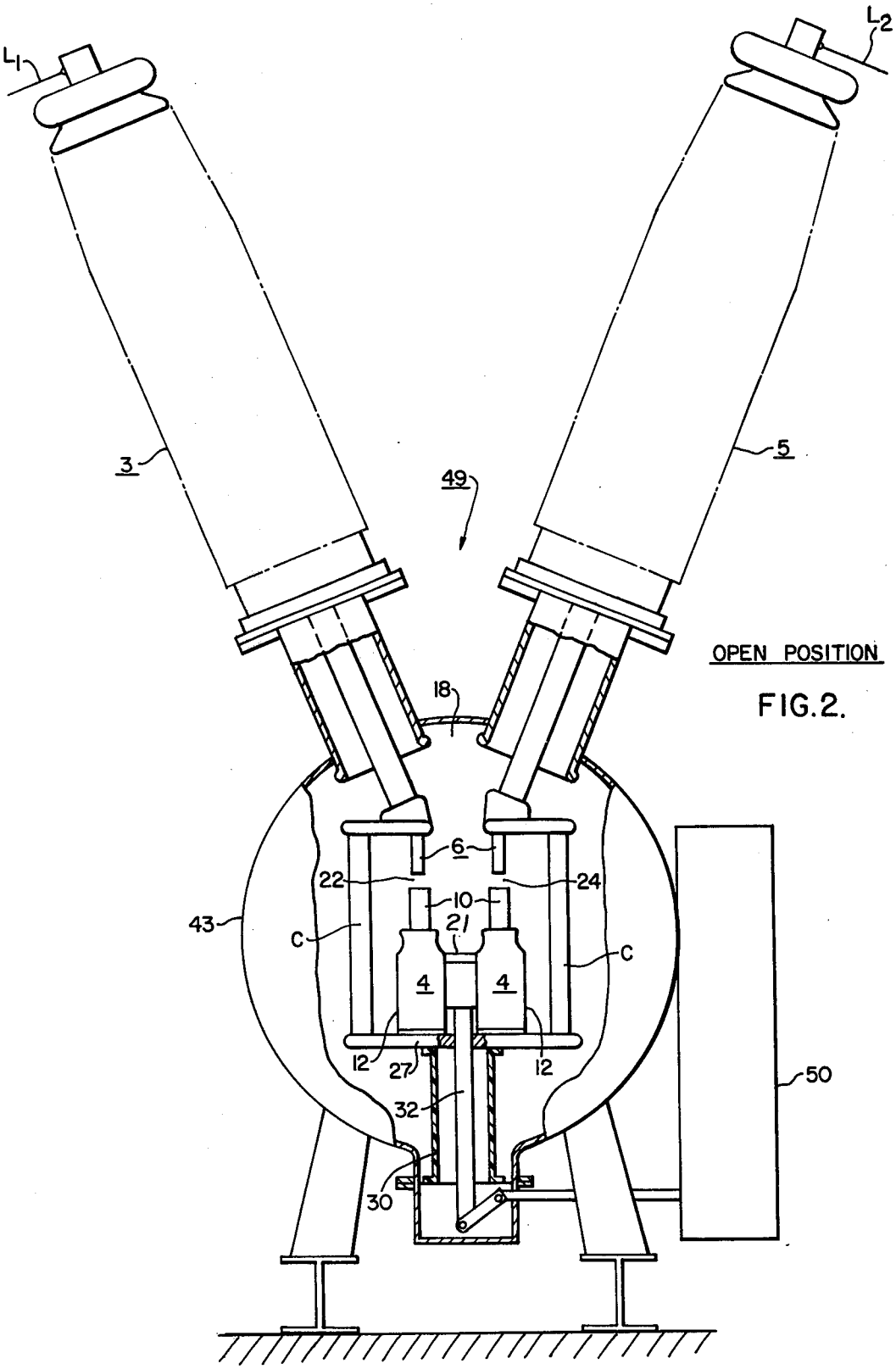
FIG. 2 illustrates another embodiment of the invention, involving a different tank shape, and again employing the principles of the present invention.
Figure 6:
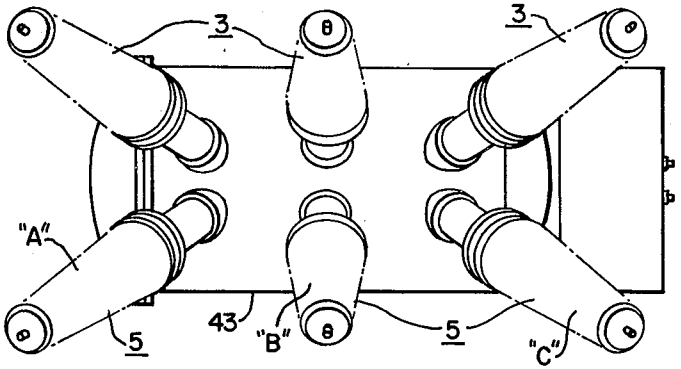
FIG. 6 is a top plan view of the tank modified construction of FIG. 5.
Figure 5:
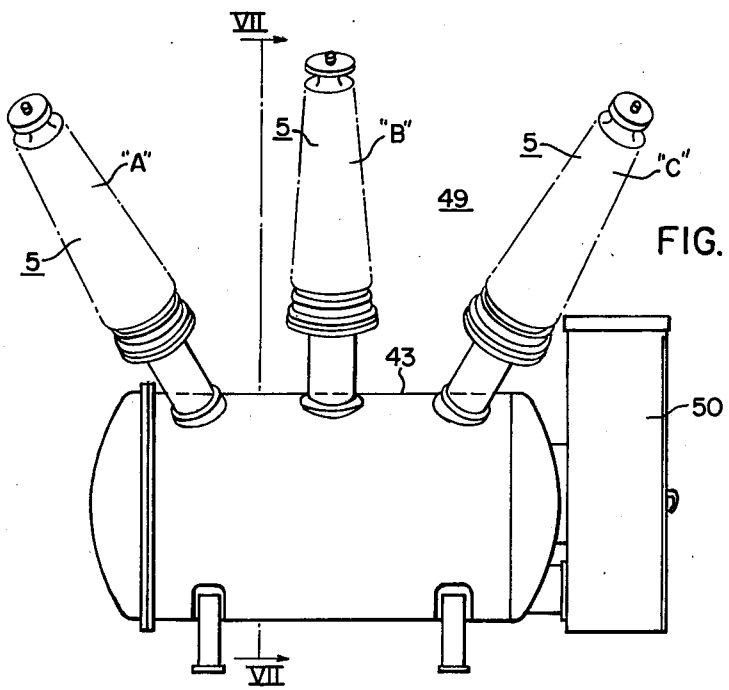
FIG. 5 is a side-elevational view of a modified-type of tank construction (of FIG. 2) incorporating the puffer-type interrupting units of the present invention.

With reference to FIG. 2, it will be observed that a modified-type of three-phase circuit-interrupter construction 49 is provided having a longitudinal cyclindrical grounded tank 43 having the three pole-unit "A," "B," and "C" provided therein as shown in FIGS. 5 and 6.

Each of these pole-units "A," "B" and "C" is of identical configuration, and follows the construction set forth heretofore in connection with FIGS. 1, 3 and 4 of the drawings; consequently, a further description thereof is not deemed necessary.

Figure 7:
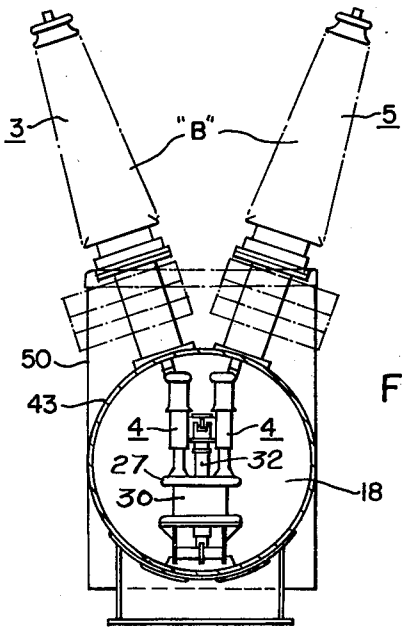
FIG. 7 is a sectional view taken substantially along the line VII—VII of FIG. 5, illustrating the contacts in the closed-circuit position; and, FIG. 8 illustrates a modified-type of circuit-interrupter construction in which the stationary contacts are alternatively supported by up-standing insulating supporting rods, the latter being secured to the main lower base-support plate of the interrupter.

FIGS. 5, 6 and 7 additionally illustrate the type of interrupter construction 49 in which the three pole-units "A," "B," and "C" are conveniently provided within a single tank structure 43, having a common operating mechanism 50, which provides simultaneous upward closing and downward opening movements of the several pole-units. Reference may be had to FIG. 7 to show the modified-type of construction in which again a pair puffer-type interrupting units 4 are simultaneously operated by a common operating mechanism.

An important advantage results from the foregoing construction, namely that the stationary contact structure 6 may either be supported by the terminal-bushings 3, 5, as illustrated in FIG. 1, or where such a terminal-bushing arrangement is not desired, optionally, the stationary contacts 6, as set forth in FIG. 8, may be supported by insulating support rods 45 extending upwardly from the lower main base-plate structure 27 of the device. Thus, the interrupter construction 4 is adaptable for different types of tank constructions, whether or not terminal-bushing 3, 5 are to be employed.

Additional advantages result in that only a single support pedestal 30 is required, and the pair of puffer interrupters 4 may be mounted parallel to one another and mechanically tied together without linkage from a common operating rod 32.

An additional advantage of the invention is that a common plate 27, to which the two puffers 4 are mounted, and to which a single support pedestal 30 may be attached. Also, there is the elimination of sliding collector fingers, commonly found necessary in the prior art, since both interrupters 4 move together, and electrical continuity may be maintained by the common yoke or tie 21 necessary for the mechanical operation.

The concept of providing enlarged lower electrostatic shielding portions **36*a* of the relatively stationary main contact fingers 36, and also the concept of shrouding, or shielding the stationary tubular hollow arcing contact 6 within the surrounding cluster of relatively stationary main contact finger 36**, is set forth in the aforesaid patent applicaton filed Sept. 25, 1975 Ser. No. 616,703 by Rostron et al.

Although there have been illustrated and described specific structures, it is to be clearly understood that the same were merely for the purpose of illustration, and that changes and modifications may readily be made therein by those skilled in the art, without departing from the spirit and scope of the invention.

I claim as my invention:

1. A double-break type of circuit-interrupter including means defining a pair of spaced stationary contacts, a pair of laterally spaced vertically arranged bottle-type puffer cylinder electrically and mechanically interconnected by a movable yoke structure, a common vertically movable operating rod having one end thereof fixedly secured to said movable yoke structure to cause the simultaneous opening and closing vertical movements of said vertically arranged bottle structures, each vertically arranged bottle structure carrying therewith a movable insulating nozzle and movable contact, the sleeve portion of the vertically movable bottle moving over a fixed piston structure, whereby compression of the gas within the bottle will cause ejection thereof through said nozzle to effect extinction of the arc established between the respective stationary and movable contacts, and a common supporting structure (27) for the two fixed piston structures for the device.

2. The combination according to claim 1, wherein an upstanding insulating pedestal (30) supports the common supporting structure (27) above ground potential from the lower end of the circuit-interrupter.

3. A tank-type double-break high-voltage gas-blast-type of circuit-interrupter assemblage, including means defining a grounded metallic tank structure (2), a pair of spaced stationary contact structures (6) disposed interiorly within said grounded tank structure, means defining a laterally spaced pair of movable contact structures also disposed within said tank structure, one of said respective stationary contact structures (6) cooperating with one of said movable contact structures (8) to establish an arc therebetween, means electrically connecting the two movable contact structures in electrical series for thereby providing a pair of serially related arcs in electrical series for interrupting high-voltage line-circuits, means defining a pair of vertically oriented laterally spaced, puffer-type interrupting structures (4), each vertically oriented puffer-type interrupting structure (4) comprising an upstanding piston member and an operatingcylinder member relatively vertically movable with respect to each other to compress gas therebetween, a supporting structure (27, 30) disposed interiorly within said metallic grounded tank structure and extending upwardly from the lower end thereof and acting to solely support said pair of laterally-spaced, vertically oriented puffer-type interrupting structures (4) in fixed relationship interiorly within said grounded metallic tank (2), means defining a vertically extended common operating rod for said two vertically oriented puffer-type interrupting structures (4) extending vertically downwardly toward the lower end of said grounded metallic tank structure and at least, in part, vertically linearly guided by said supporting structure (27, 30), means mechanically connnecting the upper end of said vertically movable common operating rod (32) with one of said aforesaid members of each of the two laterally spaced vertically oriented puffer-type interrupting structures (4) for thereby causing the simultaneous vertical movement of said one member of each of said pair of laterally spaced, vertically oriented puffer-type, interrupting structures (4), whereby simultaneous vertical operation of the two vertically oriented puffer-type interrupting structures (4) occurs to thereby force a blast of high-pressure gas vertically against the respective vertically drawn arc established within each of said respective vertically arranged puffer-type interrupting structures (4), and an operating mechanism (50) disposed externally of said grounded metallic tank structure and making operative connection with said vertically movable common operating rod.

4. The combination according to claim 3, wherein a generally ring-shaped horizontally arranged stationary supporting plate (27) stationarily supports the two vertically oriented puffer-type interrupting structures (4), and the vertically movable common operating rod (32) extends vertically downwardly through said stationary horizontally arranged ring-shaped supporting plate (27) and is guided thereby 5. The combination according to claim 3, wherein a pair of capacitance rods (C) at least partially support the stationary contacts (6) in fixed relationship and also serves to divide the impressed voltage between the two vertically oriented puffer-type interrupting structures (4).

6. The combination according to claim 4, wherein the stationary contact structure is supported by means of an insulating vertically arranged support rod (45) from the relatively fixed piston structure (14).

7. A tank-type gas-blast-type of high-voltage circuit-interrupter including means defining a grounded metallic tank structure, a pair of terminal-bushings extending downwardly into said metallic, grounded, tank structure and supporting a pair of stationary contacts therewithin, insulating supporting means extending upwardly interiorly from the lower end of said grounded metallic tank structure and supporting therewithin a pair of laterally spaced, vertically oriented bottle-type puffer-cylinders, said pair of vertically oriented laterally spaced, bottle-type puffer-cylinders being electrically and mechanically interconnected by a conducting movable yoke structure, means defining a relatively-stationary upstanding piston structure associated with each vertically arranged bottle-type puffer-cylinder, over which the latter vertically slides during the opening operation, a common vertically movable operating rod (32) for commonly vertically actuating the two vertically arranged bottle-type, puffer-cylinders and having the upper end thereof fixedly secured to said movable yoke structure to cause the simultaneous vertical opening and closing movements of said vertically oriented bottle structures, the lower end of said vertically movable common operating rod (32) extending downwardly and guided by said supporting structure, each bottle structure carrying therewith an insulating movable nozzle and a movable contact, the respective movable contact of each bottle cooperating with one of said relatively stationary contacts to establish, in combination, a pair of serially related arcs, the sleeve portion of each bottle sliding vertically over said relatively-fixed upstanding piston structure, whereby compression of the gas within the bottle will cause ejection thereof through said movable nozzle to effect extinction of the arc established between the respective stationary and the movable contacts, and an operating mechanism disposed externally of said grounded metallic tank structure and mechanically interconnected with the structure for the two relatively stationary piston structures additionally provides a desirable guiding action for the vertically linearly movable common operating rod (32).

8. The combination according to claim 7, wherein the upstanding supporting structure for the two relatively stationary upstanding piston structures additionally provides a desirable, vertical guiding action for the vertically, linearly, movable, common operating rod (32).

9. In a circuit-interrupter, means defining a relatively stationary contact, means defining a movable contact cooperable with said relatively-stationary contact to establish an arc, fluid-flow means comprising a relatively stationary piston-structure, a movable operating cylinder movable over said relatively stationary piston-structure and carrying said movable contact, an orifice member movable with the movable operating cylinder to direct compressed fluid adjacent said arc, means defining a supporting structure (27) for supporting said relatively stationary piston-structure, and a relatively stationary capacitor-rod (C) extending from said supporting structure (27) for the relatively stationary piston-structure and serving, additionally, to support the relatively stationary contact.

10. A circuit-interrupter of the dual-break type, including a pair of laterally spaced stationary contacts, a pair of movable contacts which are laterally spaced apart and cooperable with said laterally spaced stationary contacts to establish two arcs in electrical series, fluid-flow means comprising a relatively stationary supporting structure supporting a pair of laterally spaced, stationary, piston-structures, a pair of simultaneously-moved, bottle-like, operating cylinders carrying said pair of laterally spaced movable contacts, and movable over said fixed piston-structures to compress fluid therebetween, a common operating rod-means for simultaneously actuating said movable operating cylinders, a nozzle-orifice structure carried by each respective movable operating cylinder to more efficiently direct fluid-flow toward the respective established arc, and a capacitor supporting-rod (C) somewhat paralleling each fluid-flow structure and fixedly supporting the relatively stationary contact from said supporting structure.

11. The combination according to claim 10, wherein the relatively fixed supporting structure has a guide-aperture provided therein, and said common operating rod is linearly guided by said guide aperture.

* * * * *